US010914187B2

(12) United States Patent
Eastwood et al.

(10) Patent No.: US 10,914,187 B2
(45) Date of Patent: Feb. 9, 2021

(54) ACTIVE CLEARANCE CONTROL SYSTEM AND MANIFOLD FOR GAS TURBINE ENGINE

(71) Applicant: United Technologies Corporation, Farmington, CT (US)

(72) Inventors: Jonathan Jeffery Eastwood, West Hartford, CT (US); Joseph F. Englehart, Gastonia, NC (US); Graham Ryan Philbrick, Durham, CT (US); ChaiDee Woods Brown, Boca Raton, FL (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 151 days.

(21) Appl. No.: 15/700,288

(22) Filed: Sep. 11, 2017

(65) Prior Publication Data

US 2019/0078458 A1 Mar. 14, 2019

(51) Int. Cl.

| | |
|---|---|
| ***F01D 5/20*** | (2006.01) |
| ***F01D 11/24*** | (2006.01) |
| ***F01D 25/12*** | (2006.01) |

(52) U.S. Cl.

CPC ..... *F01D 11/24* (2013.01); *F01D 25/12* (2013.01); *F05D 2220/329* (2013.01); *F05D 2230/54* (2013.01); *F05D 2240/11* (2013.01); *F05D 2260/201* (2013.01)

(58) Field of Classification Search

CPC ..... F01D 11/24; F01D 25/12; F05D 2240/11; F05D 2260/201

USPC ..... 415/713.2

See application file for complete search history.

(56) References Cited

U.S. PATENT DOCUMENTS

| | | | | | |
|---|---|---|---|---|---|
| 4,053,254 | A * | 10/1977 | Chaplin | F01D 11/08 | 415/116 |
| 4,279,123 | A * | 7/1981 | Griffin | F01D 11/24 | 415/136 |
| 5,044,881 | A | 9/1991 | Dodd et al. | | |
| 5,100,291 | A * | 3/1992 | Glover | F01D 11/24 | 165/169 |
| 5,399,066 | A * | 3/1995 | Ritchie | F01D 11/24 | 165/47 |
| 5,980,201 | A * | 11/1999 | Benoist | F01D 25/14 | 415/115 |
| 6,149,074 | A * | 11/2000 | Friedel | F01D 11/24 | 165/169 |

(Continued)

FOREIGN PATENT DOCUMENTS

| | | |
|---|---|---|
| EP | 1798382 A2 | 6/2007 |
| EP | 3159493 A1 | 4/2017 |

OTHER PUBLICATIONS

European Search Report for European Application No. 18193884.6 dated Dec. 7, 2018.

*Primary Examiner* — Hung Q Nguyen
*Assistant Examiner* — Anthony Donald Taylor, Jr.
(74) *Attorney, Agent, or Firm* — Carlson, Gaskey & Olds, P.C.

(57) ABSTRACT

An active clearance control manifold assembly includes multiple arcuate manifold segments each having multiple circumferential channels axially spaced apart from one another. The circumferential channels include cooling holes facing radially inward. A tube at least partially circumscribes and fluidly interconnects the manifold segments.

20 Claims, 2 Drawing Sheets

(56) References Cited

U.S. PATENT DOCUMENTS

| | | | | |
|---|---|---|---|---|
| 6,185,925 | B1 * | 2/2001 | Proctor | F01D 11/24 415/177 |
| 6,454,529 | B1 * | 9/2002 | Zearbaugh | F01D 11/24 415/173.2 |
| 7,431,557 | B2 * | 10/2008 | Herron | F01D 11/24 415/1 |
| 7,503,179 | B2 * | 3/2009 | Estridge | F01D 11/24 415/108 |
| 7,597,537 | B2 * | 10/2009 | Bucaro | F01D 11/24 415/136 |
| 7,926,286 | B2 * | 4/2011 | Morenko | F02C 3/145 60/739 |
| 8,920,109 | B2 * | 12/2014 | Tham | F02C 9/16 415/108 |
| 9,115,595 | B2 * | 8/2015 | Snook | F01D 11/24 |
| 9,598,974 | B2 | 3/2017 | Gekht et al. | |
| 2010/0135786 | A1 * | 6/2010 | Manteiga | F01D 9/065 415/232 |
| 2010/0266393 | A1 * | 10/2010 | Saroi | F01D 11/24 415/175 |
| 2013/0149123 | A1 * | 6/2013 | Laurello | F01D 11/24 415/191 |
| 2014/0030066 | A1 * | 1/2014 | Schimmels | F01D 11/24 415/116 |
| 2014/0151347 | A1 * | 6/2014 | Evangelista | B23K 26/364 219/121.69 |
| 2015/0361827 | A1 * | 12/2015 | Pisacreta | F01D 11/24 60/806 |
| 2016/0003086 | A1 * | 1/2016 | Day | F01D 11/24 415/136 |
| 2016/0215648 | A1 | 7/2016 | Callaghan | |

* cited by examiner

ACTIVE CLEARANCE CONTROL SYSTEM AND MANIFOLD FOR GAS TURBINE ENGINE

STATEMENT REGARDING FEDERALLY SPONSORED RESEARCH OR DEVELOPMENT

This invention was made with government support under contract number W911W6-16-2-0012 with the U.S. Army. The government has certain rights in the invention.

BACKGROUND

This disclosure relates to turbomachinery, and more particularly, the disclosure relates to an active clearance control system and manifold for a gas turbine engine.

Gas turbine engines include a compressor that compresses air, a combustor that ignites the compressed air and a turbine across which the compressed air is expanded. The expansion of the combustion products drives the turbine to rotate, which in turn drives rotation of the compressor.

In order to increase efficiency, a clearance between the tips of the blades in the compressor, turbine and power turbine across the outer diameter of the flowpath is kept sufficiently small. This ensures that a minimum amount of air passes between the tips and the outer diameter. Some engines include a blade outer air seal (BOAS) supported by case structure to further reduce tip clearance.

The clearance between the BOAS and the blade tips is sensitive to the temperature of the gas path at different engine conditions. If the BOAS support structure heats up at a faster rate than the rotating blades, the tip clearance could increase and cause a drop in efficiency. Conversely, if the blades heat up at a faster rate than the BOAS support structure, the blades can undesirably rub against the BOAS. As a result, it is difficult to accommodate a consistent tip clearance during different power settings in the engine.

Active clearance control (ACC) systems have been developed to selectively direct cooling fluid at the case structure to more closely control the clearance between the BOAS and blade tips. A simpler, more effective ACC system is needed.

SUMMARY

In one exemplary embodiment, an active clearance control manifold assembly includes multiple arcuate manifold segments each having multiple circumferential channels axially spaced apart from one another. The circumferential channels include cooling holes facing radially inward. A tube at least partially circumscribes and fluidly interconnects the manifold segments.

In a further embodiment of any of the above, each manifold segments include a manifold portion that extends axially and fluidly connects the circumferential channels.

In a further embodiment of any of the above, each manifold segment includes inner and outer supply conduit portions joined to one another. At least one of the inner and outer supply conduit portions includes a recess that provides a corresponding circumferential channel.

In a further embodiment of any of the above, the circumferential channels terminate in an end blocked by a plug. The plugs of adjacent manifold segments are arranged in axial alignment and are circumferentially adjacent to one another.

In a further embodiment of any of the above, the manifold portion includes inner and outer enclosures respectively secured to the inner and outer supply conduit portions to create a cavity that fluidly supplies the circumferential channels. The tube is joined to the outer enclosure portion by an outlet.

In a further embodiment of any of the above, the inner and outer supply conduit portions and the inner and outer enclosures are provided by sheet metal structures.

In a further embodiment of any of the above, the inner and outer supply conduit portions and the inner and outer enclosures are each provided by discrete structures welded or brazed together.

In a further embodiment of any of the above, at least one of the inner and outer supply conduit portions includes multiple circumferentially spaced lightening holes arranged axially between the circumferential channels.

In a further embodiment of any of the above, the manifold segments are mirror images of one another.

In a further embodiment of any of the above, the number of manifold segments is four.

In a further embodiment of any of the above, the number of circumferential channels provided by each manifold segment is four.

In another exemplary embodiment, an active clearance control manifold assembly includes an arcuate manifold segment that has multiple circumferential channels axially spaced apart from one another. The circumferential channels include cooling holes that face radially inward. The manifold segment includes inner and outer supply conduit portions joined to one another. At least one of the inner and outer supply conduit portions includes a recess that provides a corresponding circumferential channel. The manifold segment includes a manifold portion that extends axially and fluidly connects the circumferential channels. The manifold portion includes inner and outer enclosures respectively secured to the inner and outer supply conduit portions to create a cavity that fluidly supplies the circumferential channels.

In a further embodiment of any of the above, the inner and outer supply conduit portions are each discrete from the inner and outer enclosures.

In a further embodiment of any of the above, the inner and outer supply conduit portions and the inner and outer enclosures are welded or brazed together.

In a further embodiment of any of the above, the number of circumferential channels provided by the manifold segment is four.

In a further embodiment of any of the above, the circumferential channels terminate in an end blocked by a plug.

In another exemplary embodiment, a gas turbine engine includes a combustor section arranged fluidly between a compressor section, a turbine section and a power turbine. The compressor section includes a bleed stage. The turbine section has a turbine case. An active clearance control manifold assembly includes multiple arcuate manifold segments arranged circumferentially about the power turbine case. Each of the multiple manifold segments have multiple circumferential channels axially spaced apart from one another. The circumferential channels have cooling holes directed at the power turbine case. A tube at least partially circumscribes and fluidly interconnects the manifold segments. The tube is fluidly connected to the compressor section.

In a further embodiment of any of the above, the turbine section includes a power turbine arranged fluidly downstream from a high pressure turbine. The turbine case is provided in the power turbine. The turbine case supports blade outer air seals spaced axially apart from one another.

A number of circumferential channels correspond to a number of axially spaced apart blade outer air seals.

In a further embodiment of any of the above, the number of axially spaced apart circumferential channels is four.

In a further embodiment of any of the above, the tube includes a single inlet and four outlets. Each of the outlets are fluidly connected to a corresponding manifold segment.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible. Like reference numbers and designations in the various drawings indicate like elements.

DETAILED DESCRIPTION

Figure 1:
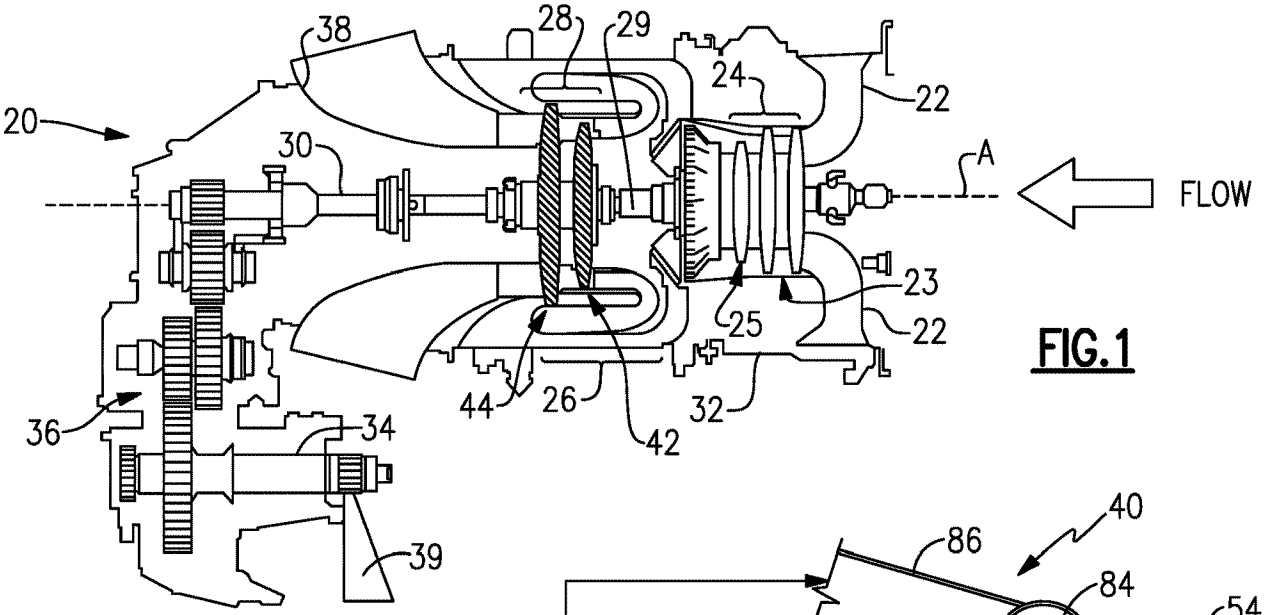
FIG. 1 is a schematic view of a gas turbine engine for use in a helicopter.

FIG. 1 schematically illustrates a gas turbine engine 20. In this example, the engine 20 is a turboshaft engine, such as for a helicopter. The engine 20 includes an inlet duct 22, a compressor section 24, a combustor section 26, and a turbine section 28.

The compressor section 24 is an axial compressor and includes a plurality of circumferentially-spaced blades. Similarly, the turbine section 28 includes circumferentially-spaced turbine blades. The compressor section 24 and the turbine section 28 are mounted on a main shaft 29 for rotation about an engine central longitudinal axis A relative to an engine static structure 32 via several bearing systems (not shown).

During operation, the compressor section 24 draws air through the inlet duct 22. Although gas turbine engines ingest some amount of dust, such engines are typically not designed for highly dusty environments. Engines such as the engine 20 are subject to operating in highly dusty environments during takeoff and landing. In this example, the inlet duct 22 opens radially relative to the central longitudinal axis A. The compressor section 24 compresses the air, and the compressed air is then mixed with fuel and burned in the combustor section 26 to form a high pressure, hot gas stream. The hot gas stream is expanded in the turbine section 28, which may include first and second turbine 42, 44. The first turbine 42 rotationally drives the compressor section 24 via a main shaft 29. The second turbine 44, which is a power turbine in the example embodiment, rotationally drives a power shaft 30, gearbox 36, and output shaft 34. The power turbine can be made up of a single or multiple stages of blades and vanes. The output shaft 34 rotationally drives the helicopter rotor blades 39 used to generate lift for the helicopter. The hot gas stream is expelled through an exhaust 38.

The engine 20 also includes a seal system in the turbine section 28 around the blades. Such a seal system may be referred to as a blade outer air seal (BOAS). The seal system serves to provide a minimum clearance around the tips of the blades, to limit the amount of air that escapes around the tips.

Figure 2:
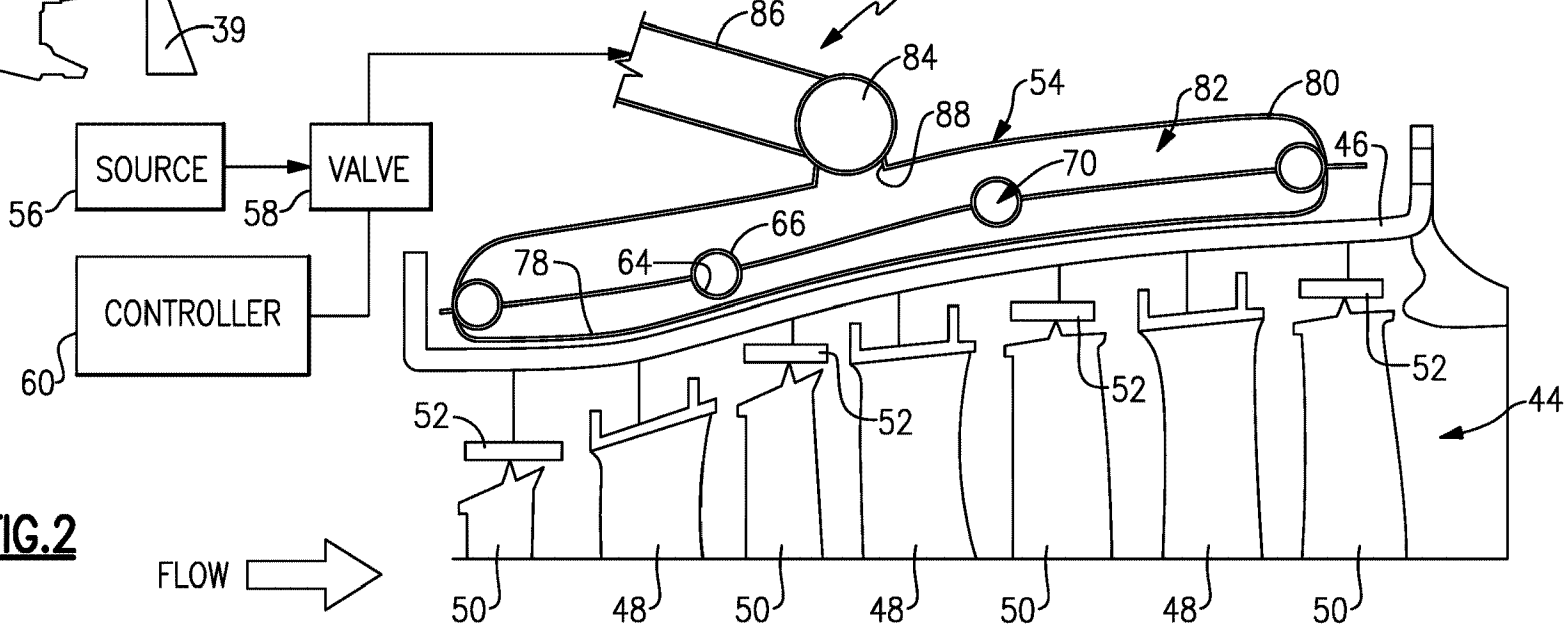
FIG. 2 is a schematic cross-sectional view through a power turbine of the gas turbine engine shown in FIG. 1.

The power turbine 44 is shown in more detail in FIG. 2. The power turbine 44 includes stages of stator vanes 48 axially spaced apart from one another and supported with respect to the turbine case structure 46, which is part of the engine static structure 32. Stages of rotor blades 50 are axially interspersed between the stages of stator vanes 48.

FIG. 2 illustrates a representative portion of a BOAS 52 of the seal system. The BOAS 52 are supported with respect to the case structure 46 to provide a seal with respect to the tips of the rotor blades 50. As will be appreciated, the BOAS 52 may be an arc segment, a full ring, a split ring that is mounted around the blades 50, or an integration into an engine casing.

An active clearance control (ACC) system 40 includes a source 56 of cooling fluid, which may be one of the bleed air from the compressor section 24. Cooling air to the outside of the case may be provided by air, between a low pressure compressor 23 and a high pressure compressor 25 of the compressor section 24, shown in FIG. 1. The air source could also be from other sources in the compression system such as behind the fan, such as a first rotating stage of the engine, or from the high pressure compressor. This air has a high enough pressure to provide effective impingement cooling onto the case structure 46 and a low enough temperature to cool the case structure 46 to the desired temperature. The ACC system 40 controls the running tip clearance of the blades 50 by varying the amount of cooling air on the case structure 46.

The cooling fluid is provided to a control valve 58, which is selectively controlled by a controller 60 to maintain a desired clearance between the case structure 46 and the blades 50 to target a specific tip clearance value at a given power turbine speed. The controller 60 and may receive inputs from various temperature sensors or other sensing elements (not shown).

The ACC system 40 includes a sheet metal manifold 54 which surrounds the outside of the case structure 46. The manifold 54 blows air on the outside of the case structure 46 in the area directly above a hook connection, for example, of the BOAS 52 and the case structure 46.

Figure 3:
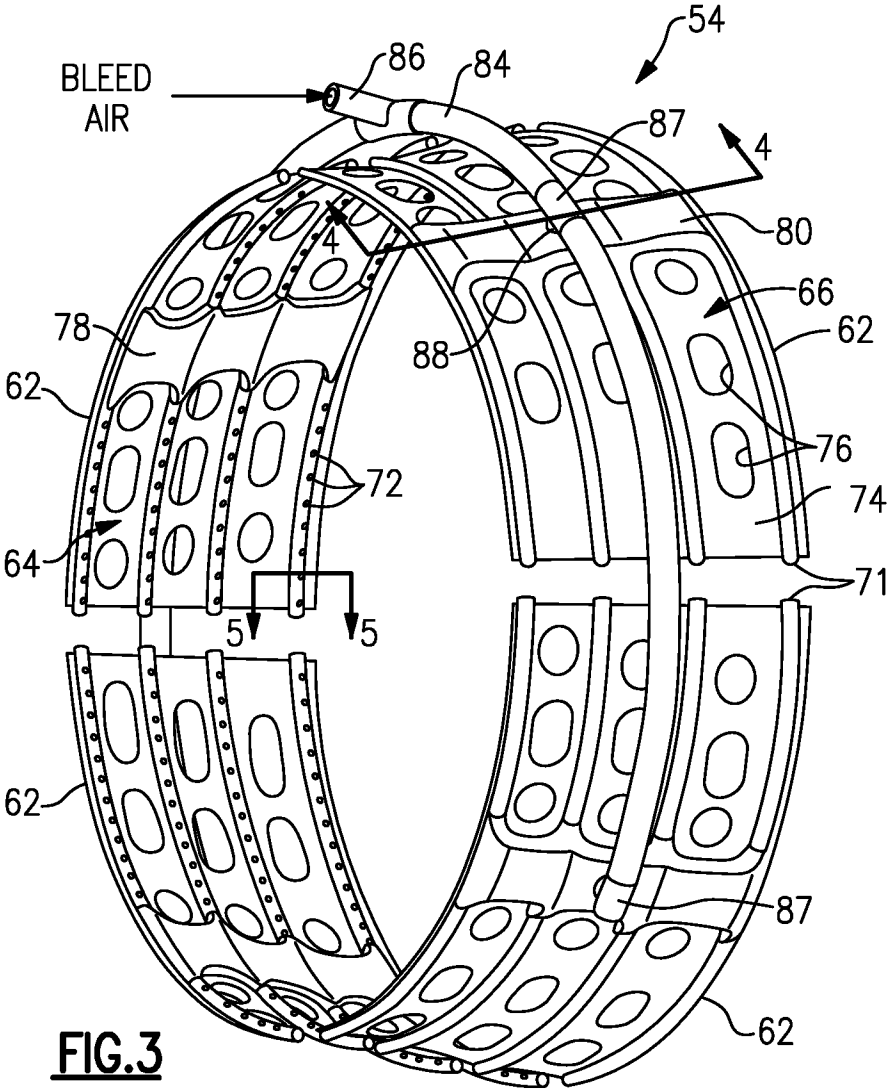
FIG. 3 is a perspective view of an active clearance control manifold embodiment.

Referring to FIGS. 2 and 3, an example manifold 54 is shown, which includes multiple segments, for example, four manifold segments 62. In the example, the manifold segments 62 are mirror images of one another and are arcuate in shape. The manifold segments 62 are constructed from several stamped sheet metal elements secured to one another by welds or braze 75 (FIG. 4), although other construction techniques may be used. In the example, there are four discrete components secured to one another to form each manifold segment: inner and outer supply conduit portions 64, 66 and inner and outer enclosures 78, 80; however, it should be understood that more or fewer components may be used. For example, the inner supply conduit portion 64 and inner enclosure 78 may be combined into a single unitary structure, and the outer supply conduit portion 66 and outer enclosure 80 may be combined into a single unitary structure.

Figure 5:
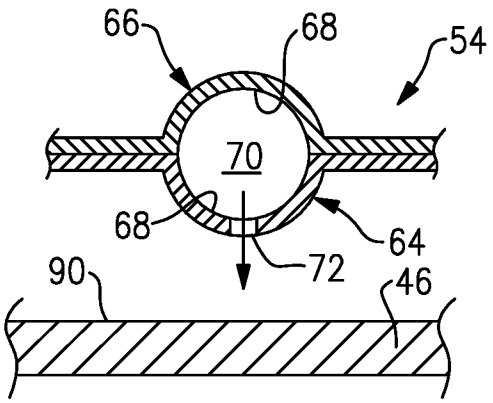
FIG. 5 is a cross-sectional view taken along 5-5 in FIG. 3 and shown in relation to a case structure.

Each manifold segment 62 has multiple circumferential channels 70 axially spaced apart from one another and formed by recesses 68 in each of the inner and outer supply conduit portions 64, 66 that are joined to one another. At least one of the inner and outer supply conduit portions 64, 66 includes multiple circumferentially spaced lightening holes 76 in flanges 74 arranged axially between and interconnecting the circumferential channels 70. The circumferential channels 70 include cooling holes 72 facing radially inward and directed at an outer surface 90 of the case structure 46, as best shown in FIG. 5.

In the example, the number of circumferential channels 70 corresponds to the number of axially spaced blade outer air seals 52, here, four. The circumferential channels 70 each terminate in an end blocked by a plug 71 (FIG. 3). The plugs 71 of adjacent manifold segments 62 are arranged in axial alignment and are circumferentially adjacent to one another.

Figure 4:
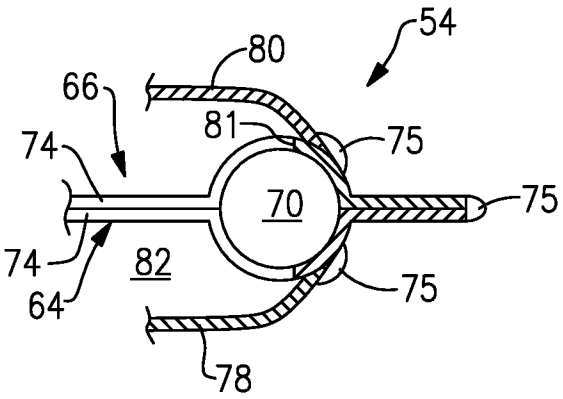
FIG. 4 is a partial cross-sectional view taken along a portion of the line 4-4 in FIG. 3.

Referring to FIG. 4, at least one of the inner and outer supply conduit portions 64, 66 includes a notch 81 that provides an inlet to the circumferential channels 70. A manifold portion provided by the inner and outer enclosures 78, 80 is arranged over the notch 81 and extends axially, as shown in FIG. 3. The manifold portion creates a cavity 82 that fluidly supplies the circumferential channels 70 with cooling fluid.

A tube 84 at least partially circumscribes and fluidly interconnecting the manifold segments 62. In the example, the tube 84 includes a single inlet 86 and four outlets, each of the outlets 87 fluidly connected to a corresponding manifold segment 62. The tube 84, which is fluidly connected to the bleed stage, is joined to a hole 88 in each of the outer enclosure 80 by the outlet 87.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. An active clearance control manifold assembly comprising:

multiple arcuate manifold segments each having multiple circumferential channels axially spaced apart from one another, each of the circumferential channels including cooling holes facing radially inward;

wherein each arcuate manifold segment includes inner and outer supply conduit portions joined to one another, each arcuate manifold segment having inner and outer enclosures respectively secured to the inner and outer supply conduit portions to create a cavity that fluidly supplies each of the circumferential channels, at least one of the inner and outer supply conduit portions having a notch that provides a channel inlet to the corresponding circumferential channel, wherein the inner and outer enclosures extend in an axial direction and are arranged over the notch, each of the circumferential channels terminating at blocked ends, such that the respective blocked ends of adjoining arcuate manifold segments are arranged circumferentially adjacent to one another;

wherein the inner and outer enclosures operatively supports the inner and outer supply conduit portions, the inner and outer enclosures terminating in the axial direction at arcuate ends that define each arcuate manifold segment as a discrete structure from the other arcuate manifold segments, wherein the blocked ends and arcuate ends of the respective arcuate manifold segment adjoin one another; and a tube at least partially circumscribing and fluidly interconnecting the arcuate manifold segments, the tube comprising a tube inlet and a plurality of tube outlets such that the tube is joined to each of the outer enclosures by a respective tube outlet of the plurality of tube outlets.

2. The manifold assembly of claim 1, wherein each of the circumferential channels are formed by recesses in each of the inner and outer supply conduit portions.

3. The manifold assembly of claim 1, wherein each of the blocked ends are blocked by a plug, the plugs of adjacent arcuate manifold segments arranged in axial alignment and arranged circumferentially adjacent to one another.

4. The manifold assembly of claim 1, wherein the inner and outer supply conduit portions and the inner and outer enclosures are each provided by sheet metal structures.

5. The manifold assembly of claim 4, wherein the inner and outer supply conduit portions and the inner and outer enclosures are welded or brazed together.

6. The manifold assembly of claim 1, wherein at least one of the inner and outer supply conduit portions includes multiple circumferentially spaced lightening holes arranged axially between the circumferential channels.

7. The manifold assembly of claim 1, wherein the arcuate manifold segments are mirror images of one another.

8. The manifold assembly of claim 7, wherein the number of arcuate manifold segments and corresponding outer enclosures is four.

9. The manifold assembly of claim 1, wherein the number of circumferential channels provided by each arcuate manifold segment is four.

10. An active clearance control manifold assembly comprising:

multiple arcuate manifold segments each having multiple circumferential channels axially spaced apart from one another, each of the circumferential channels including cooling holes facing radially inward;

wherein each arcuate manifold segment includes inner and outer supply conduit portions joined to one another, each arcuate manifold segment having inner and outer enclosures respectively secured to the inner and outer supply conduit portions to create a cavity that fluidly supplies each of the circumferential channels, at least one of the inner and outer supply conduit portions having a notch that provides a channel inlet to the corresponding circumferential channel, wherein the inner and outer enclosures extend in an axial direction and are arranged over the notch, each of the circumferential channels terminating at blocked ends, such that the respective blocked ends of adjoining arcuate manifold segments are arranged circumferentially adjacent to one another;

wherein at least one of the inner and outer supply conduit portions includes multiple circumferentially spaced lightening holes arranged axially between the circumferential channels; and wherein the inner and outer enclosures operatively support the inner and outer supply conduit portions, the inner and outer enclosures terminating in the axial direction at arcuate ends that define each arcuate manifold segment as a discrete structure from the other arcuate manifold segments, wherein the blocked ends and arcuate ends of the respective arcuate manifold segment adjoin one another.

11. The manifold assembly of claim 10, wherein the inner and outer supply conduit portions are each discrete from the inner and outer enclosures.

12. The manifold assembly of claim 11, wherein the inner and outer supply conduit portions and the inner and outer enclosures are welded or brazed together.

13. The manifold assembly of claim 10, wherein the number of circumferential channels provided by each arcuate manifold segment is four.

14. A gas turbine engine comprising:

a combustor section arranged between a compressor section and a turbine section, wherein the compressor section includes a bleed stage, and the turbine section includes a power turbine and a turbine case;

an active clearance control manifold assembly including multiple arcuate manifold segments arranged circumferentially about the turbine case, each arcuate manifold segment having multiple circumferential channels axially spaced apart from one another, each of the circumferential channels including cooling holes facing radially inward and directed at the turbine case; and a tube at least partially circumscribing and fluidly interconnecting the arcuate manifold segments, the tube comprising a tube inlet and a plurality of tube outlets;

wherein each arcuate manifold segment includes inner and outer supply conduit portions joined to one another, each arcuate manifold segment having inner and outer enclosures respectively secured to the inner and outer supply conduit portions to create a cavity that fluidly supplies each of the circumferential channels, at least one of the inner and outer supply conduit portions having a notch that provides a channel inlet to the corresponding circumferential channel, wherein the inner and outer enclosures extend in an axial direction and are arranged over the notch, each of the circumferential channels terminating at blocked ends, such that the respective blocked ends of adjoining arcuate manifold segments are arranged circumferentially adjacent to one another; and wherein the inner and outer enclosures operatively support the inner and outer supply conduit portions, the inner and outer enclosures terminating in the axial direction at arcuate ends that define each arcuate manifold segment as a discrete structure from the other arcuate manifold segments, wherein the blocked ends and arcuate ends of the respective arcuate manifold segment adjoin one another.

15. The gas turbine engine of claim 14, wherein the power turbine is a second turbine with respect to a first turbine that rotationally drives the compressor section via a main shaft, and wherein the turbine case supports blade outer air seals spaced axially apart from one another, such that a number of the circumferential channels corresponds to a number of the blade outer air seals.

16. The gas turbine engine of claim 15, wherein the number of axially spaced apart circumferential channels is four.

17. The gas turbine engine of claim 14, wherein the tube is joined to each of the outer enclosures by a respective tube outlet of the plurality of tube outlets.

18. The manifold assembly of claim 12, wherein the inner and outer enclosures are formed from sheet metal.

19. The gas turbine engine of claim 14, wherein the inner and outer supply conduit portions and the inner and outer enclosures are welded or brazed together.

20. The gas turbine engine of claim 15, wherein the number of blade outer air seals is four, and each of the arcuate manifold segments has four circumferential channels.

* * * * *